US005359981A

United States Patent [19]

Kim

[11] Patent Number: 5,359,981

[45] Date of Patent: Nov. 1, 1994

[54] APPARATUS FOR PREVENTING ELECTRO-MAGNETIC WAVE NOISE FROM BEING RADIATED AND CONDUCTED FROM IGNITING DEVICE OF GASOLINE ENGINE

[75] Inventor: Kwi-Ju Kim, Kwangju, Rep. of Korea

[73] Assignee: ASIA Motors Co., Inc., Seoul, Rep. of Korea

[21] Appl. No.: 65,329

[22] Filed: May 21, 1993

[30] Foreign Application Priority Data

Jun. 23, 1992 [KR] Rep. of Korea ..... 1992-10899

[51] Int. Cl.[5] ..... F02P 11/00

[52] U.S. Cl. ..... 123/633; 123/143 C; 123/654

[58] Field of Search ..... 123/143 C, 633, 647, 123/654; 361/400

[56] References Cited

U.S. PATENT DOCUMENTS

| | | | |
|---|---|---|---|
| 2,462,489 | 2/1949 | Hallett | 123/633 |
| 3,492,622 | 1/1970 | Hayashi et al. | 123/633 X |
| 3,556,069 | 1/1971 | Minks | 123/143 C |
| 3,965,879 | 6/1976 | Fitzner | 123/633 |
| 3,967,230 | 6/1976 | Kamigaito | 123/633 X |
| 4,691,667 | 9/1987 | Eberhardt et al. | 123/143 C X |
| 4,875,457 | 10/1989 | Fitzner | 123/633 |
| 5,181,498 | 1/1993 | Koiwa et al. | 123/633 |

*Primary Examiner*—Tony M. Argenbright
*Attorney, Agent, or Firm*—Lowe, Price, LeBlanc & Becker

[57] ABSTRACT

An apparatus for preventing the radiation and conduction of electro-magnetic wave noises generated from the igniting device of a gasoline engine is disclosed. The igniting portion of a gasoline engine such as an igniting coil, a continuously contacting and opening contact breaker, a power distributor, and igniting plugs generate all kinds of electro-magnetic wave noises of wide frequency bands. These noises give adverse effects to the various components of an automobile or an air plane such as electric and electronic convenience devices, safety devices and engine controllers, resulting in malfunctions of the components. By shielding and absorbing such electro-magnetic wave noises, an automobile or an air plane is protected from possible accidents, and human lives are saved.

1 Claim, 2 Drawing Sheets

APPARATUS FOR PREVENTING ELECTRO-MAGNETIC WAVE NOISE FROM BEING RADIATED AND CONDUCTED FROM IGNITING DEVICE OF GASOLINE ENGINE

FIELD OF THE INVENTION

The present invention relates to an apparatus for preventing an electro-magnetic wave noise from being radiated and conducted from the igniting device of a gasoline engine, so that such an electro-magnetic wave noise should be prevented from giving adverse effect to the components of the automobile, thereby preventing accidents and saving human lives.

BACKGROUND OF THE INVENTION

Generally, if a gasoline engine is started by inserting a key into the igniting switch of the engine, the engine is driven by the battery power. In this case, an electro-magnetic wave noise, which is conducted through the wires, and which is radiated from various components such as the high voltage glow discharge of igniting plugs, coils, contacts of the igniting device, the power distribution system, the igniting coils of the igniting device, gives influences to various electric and electronic gauges, convenience devices (such as power window, auto suspension, navigation system, various warning devices, and gauge system), safety devices (such as antilock brake system, air bag, power steering, and cruise control system), engine controller and the like. That is, the indicating needles of the gauges can be oscillated, and the controller can malfunction, and therefore, a running automobile or a flying air planes can make a fatal accident. Further, the electro-magnetic wave noise can give tiredness to the driver, as well as shortening the life expectancy of the automobiles.

SUMMARY OF THE INVENTION

The present invention is intended to overcome the above described disadvantages of the conventional device.

Therefore it is the object of the present invention to provide an apparatus for preventing the radiation and conduction of the electro-magnetic wave noise generated by the igniting device of a gasoline engine, in which noise absorbing or noise shielding devices are used to convert the noise into energy to make the energy flow to the automobile body, thereby preventing possible accidents.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
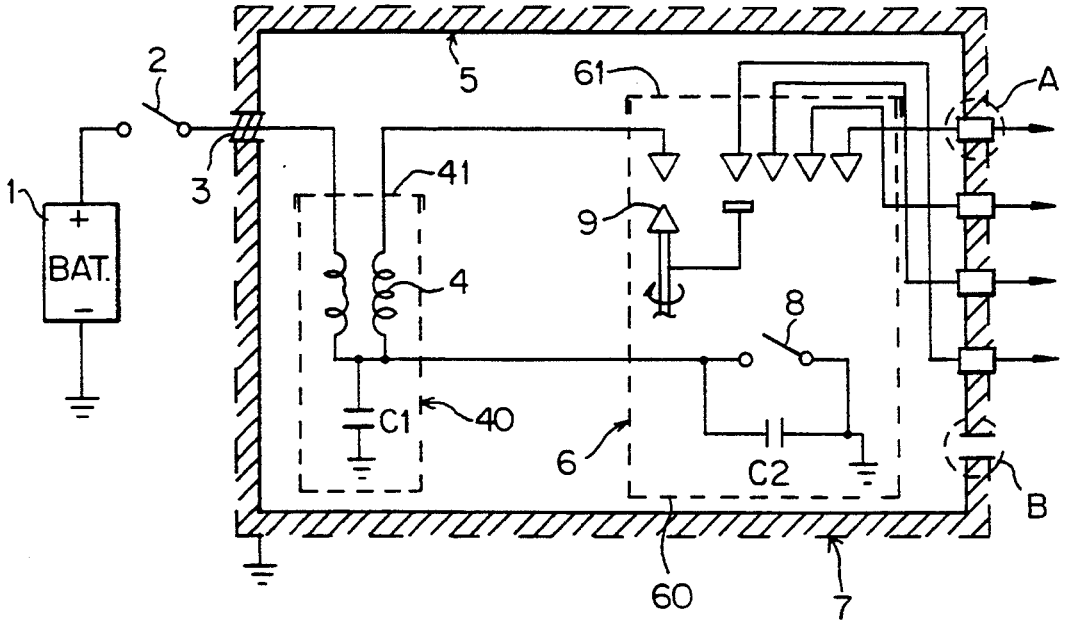
FIG. 1 illustrates the constitution of the apparatus according to the present invention.

Referring to FIG. 1, a through capacitor 3 is inserted between an igniting coil 4 for generating a high voltage and an igniting switch 2 which is connected to a battery power source. The ignition coil 4 is contained is a closed steel box 40, and a cap 41 of the box is made of an insulating ferrite or a synthetic resin, while the negative terminal of the primary coil is connected to a ceramic capacitor C1. A power distributor 6 which is connected to an igniting coil 4 includes a power distributing switch 8, and the switch 8 includes a protecting capacitor C2 for protecting the contact of a contact breaker and for preventing the glow discharge of the contact of the power distributing switch 8. The power distributor 6 is housed in a steel box 60 for shielding the electro-magnetic noise, and a cap 61 is made of an insulating resin or a metal sheet.

Further, there is provided a portion A which is connected through the power distributor 6 to respective igniting plug 50, and there is also provided a portion B which is a hole.

Figure 2:
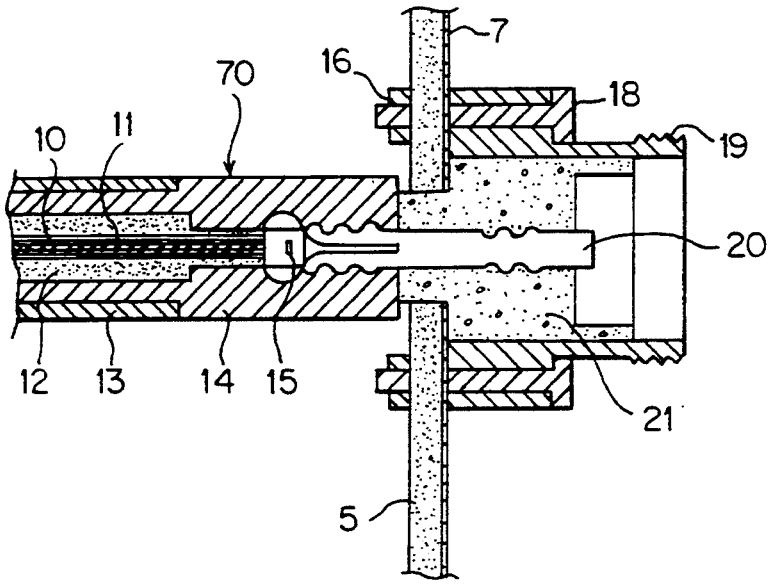
FIG. 2 is an enlarged sectional view for the portion A of FIG. 1.

As shown in FIG. 2, the portion A is constituted such that an insulating ferrite 21 is inserted through a shielding box 7 and through a ferrite sealant 5, and a shielding shell 19 is fitted to the outside of the insulating ferrite 21, with a fastening being made by means of a bolt 18 and a nut 16. Further a central terminal 20 of the igniting cable 70 is made to pass through the insulating ferrite 21.

Figure 5:
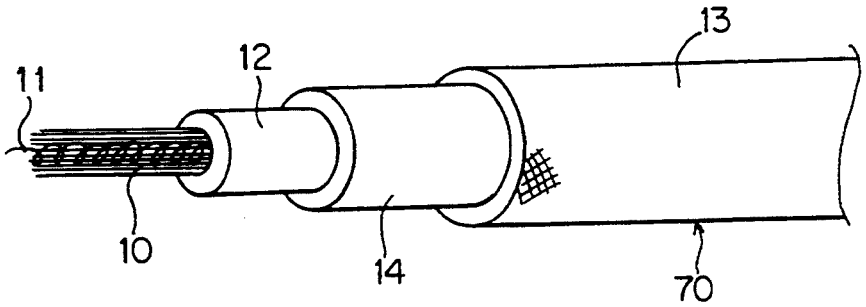
FIG. 5 illustrates the constitution of the igniting cable according to the present invention.

As shown in FIG. 5, the igniting cable 70 includes an inductance/resistance wire 11 and core wires 10, and a ferrite absorber 12 surrounds the core wires 10. Further, a wire network 13 surrounds the ferrite absorber 12, and an insulating rubber cladding 14 surrounds the wire network 13.

Figure 3:
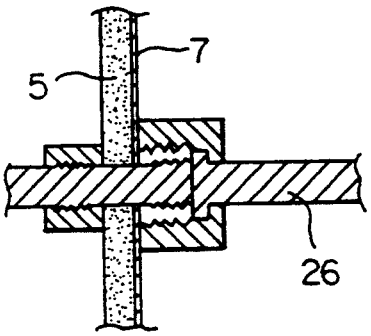
FIG. 3 is an enlarged sectional view for the portion B of FIG. 1.

As shown in FIG. 3, the portion B which is a vacuum promoting pipe passing hole is constituted such that a steel pipe or a rubber pipe 26 passes through the ferrite sealant 5 and the shielding box 7. Further, a sealing is formed by means of the ferrite sealant 5, that is, all the gaps and slits of the shielding box 7 are sealed by the means of the ferrite sealant 5.

Meanwhile, the whole igniting device is enclosed in the steel shielding box 7, and the ferrite sealant 5 is attached to the inside walls of the shielding box 7 by means of bolts.

Figure 4:
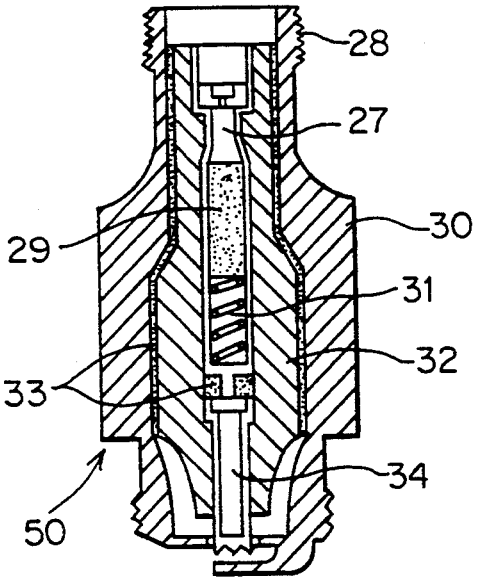
FIG. 4 is a sectional view showing the igniting plug according to the present invention.

FIG. 4 is a sectional view of the igniting plug according to the present invention, and the plug 50 is constituted such that a seal 33 is applied between a shielding sheet 30 and an insulating ferrite 32, while a resistance member 29, a spring 31 and a central electrode are included inside thereof.

Reference numeral 27 in the drawing indicates resistance rubber plate, and 28 indicates a screw.

The apparatus of the present invention constituted as above will now be described as to its operation.

If the driver starts the engine by inserting the key into the igniting switch, then the igniting switch 2 is short-circuited, so that power should be supplied from the battery 1 to the primary coil of the igniting coil 4. Under this condition, the electro-magnetic wave noise of the primary current and the induced current is bypassed by the through capacitor 3. That is, the electro-magnetic wave noise of a low frequency band (20–900 Hz) is bypassed by about 10 dB, while the electro-magnetic wave noise of a low frequency band (20–2,000 Hz)

is damped by the ceramic capacitor C1 of the igniting coil 4.

Meanwhile, the primary current of the igniting coils 4 short-circuits the power distributing switch 8 of the power distributor 6, and, under this condition, the capacitor C2 which is for protecting the contacts of the contact breaker also damps the noise of the low frequency band (20–2,000 Hz) The primary current induces a high voltage in the secondary coil, and this high voltage which passes through the respective contact breaker's contacts 9 produces sparks between the electrodes of the igniting plug 50 to put the mixed gases of the combustion chamber to a combustion. In this process, the ferrite absorber 12 of the igniting cable 70 which is formed within the shielding box 7 damps the electro-magnetic wave noise of a wide frequency band (20 Hz–50 MHz) by about 20 dB.

Further, the ferrite sealant 5 which is attached to the shielding box 7 also absorbs the electro-magnetic wave noise to convert the noise to a thermal energy. That is, the noise of a low frequency band (1 MHz or less) is shielded by the physical property of the ferrite sealant 5, and the shielding box 7 also shields off the electro-magnetic noise.

The ferrite Sealant 5 which seals off all the gaps and slits of the shielding box 7 shields off the electro-magnetic wave noise of a low frequency band (20 Hz or less), and further, the ferrite sealant 5 converts the noise of a wide frequency band (20 Hz–1 GHz) to a thermal energy. Further, the igniting cable 70 which passes through the shielding box 7 also damps the electro-magnetic wave noise by means of the ferrite absorber 12, while the wire networks 13 guides the noise energy to ground, thereby converting the noise to a thermal energy.

Further, the electro-magnetic wave noise is damped by the resistance member (2 KΩ) 29 which is inserted into the igniting plug 50, and the electro-magnetic wave noise is bypassed by being grounded by the wire network 13. Further, the resistance member 29 absorbs and shields the electro-magnetic wave noise generated by the sparks of the igniting plug 50, and also grounds and shields the conducting noise of the igniting cables 70.

According to the present invention as described above, the electro-magnetic wave noise which gives adverse influence to the various components of the automobile is all shielded and absorbed. That is, when the igniting switch 2 is short-circuited, the contacts 9 of the contact breaker repeats short-circuiting and opening, and electro-magnetic wave noises are produced from the igniting coil 4, the contacts of the contact breaker 9, the contacts of the power distributing switch 8, and the igniting plug 50. All these noises are shielded and absorbed by the apparatus of the present invention, thereby preventing possible accidents of automobiles and air planes, and saving human lives.

What is claimed is:

1. An apparatus for preventing the radiation and conduction of an electro-magnetic wave noise generated by the ignition device of a gasoline engine, comprising:

a ceramic capacitor (C1) for absorbing an electro-magnetic wave noise of a low frequency band generated by an igniting coil (4);

a contact breaker contact protecting capacitor (C2) for damping an electro-magnetic wave noise of a low frequency band generated by and conducted from a power distributor (6);

a through capacitor (3) for damping a conducted noise of a low frequency band generated from between an igniting switch (2) and said igniting coil (4);

a shielding box (7) for shielding and bypassing a conduction noise generated from said igniting coil (4);

a ferrite sealant (5) unitizingly attached to the inside of said shielding box (7) in such a manner as to seal off all the gaps and slits of said shielding box (7), and for absorbing a conduction noise of a low frequency band to convert the noise to a thermal energy;

a ferrite absorber (12) provided as a part of an igniting cable (70) connected to said igniting device, and for damping an electro-magnetic wave noise of a wide frequency band;

a wire network (13) provided as the outer part of said igniting cable (70), and for bypassing the conduction of an electro-magnetic wave noise; and a resistance member (29) disposed inside an igniting plug (50), and for damping and converting the absorbed noise into a thermal energy to bypass it to ground.

* * * * *